US005722101A

United States Patent [19]

Grigoriev

[11] Patent Number: 5,722,101

[45] Date of Patent: Mar. 3, 1998

[54] MULTI-FRAMED CONVERTIBLE ARTICLE OF FURNITURE

[76] Inventor: Nikita Grigoriev, P.O. Box 1410, Richfield Springs, N.Y. 13439

[21] Appl. No.: 649,528

[22] Filed: May 17, 1996

[51] Int. Cl.[6] ..... A47C 17/04

[52] U.S. Cl. ..... 5/37.1; 5/38; 297/354.13; 297/423.27

[58] Field of Search ..... 5/37.1, 38, 52, 5/13; 297/377, 354.13, 423.3, 423.27

[56] References Cited

U.S. PATENT DOCUMENTS

| | | | |
|---|---|---|---|
| 935,861 | 10/1909 | Pudrith | 5/38 |
| 1,192,318 | 7/1916 | Inco | 5/38 |
| 1,947,410 | 2/1934 | Emerson | 297/423.27 |
| 2,200,647 | 8/1940 | Vanderploeg . | |
| 2,562,197 | 7/1951 | Martin | 5/38 |
| 2,847,684 | 8/1958 | Pompon | 5/38 |
| 4,538,308 | 9/1985 | Gregoriev . | |
| 4,829,611 | 5/1989 | Fireman et al. . | |
| 4,996,730 | 3/1991 | Fireman et al. . | |
| 5,083,333 | 1/1992 | Newton . | |
| 5,129,114 | 7/1992 | Withers . | |
| 5,153,952 | 10/1992 | Barton et al. . | |
| 5,201,083 | 4/1993 | Johnson . | |
| 5,249,317 | 10/1993 | Farlow . | |
| 5,303,432 | 4/1994 | Fitts . | |
| 5,327,591 | 7/1994 | Fireman et al. . | |
| 5,345,626 | 9/1994 | Newton . | |
| 5,485,638 | 1/1996 | Newton . | |
| 5,519,902 | 5/1996 | Meade | 5/38 |

FOREIGN PATENT DOCUMENTS

| | | | |
|---|---|---|---|
| 785321 | 10/1957 | United Kingdom | 5/38 |

*Primary Examiner*—Flemming Saether
*Attorney, Agent, or Firm*—Schmeiser, Olsen & Watts

[57] ABSTRACT

An article of furniture is disclosed which includes a foldable frame assembly including a seat frame and a back rest frame. The article of furniture includes an integral frame. A trifold configuration and two bifold configurations are disclosed. A four-bar linkage is disclosed to provide added stability. As part of the four-bar linkage, a leg is hingedly attached to the back rest frame. A linkage interconnects the leg and the seat frame such that the leg retracts proximate the frame when the article furniture is in a seat position and extends away from the frame when said article of furniture is in an extended horizontal position. A release mechanism is also disclosed which is hingedly attached to the seat frame for assisting opening and closing the seat frame when the article of furniture is being placed in a seat position.

13 Claims, 4 Drawing Sheets

MULTI-FRAMED CONVERTIBLE ARTICLE OF FURNITURE

FIELD OF THE INVENTION

The present invention relates generally to convertible furniture usable in a horizontal position or in a seat position, and in particular to a folding mechanisms for furniture usable in a horizontal position or in a seat position.

BACKGROUND OF THE INVENTION

Heretofore, various types of convertible furniture and folding mechanisms therefor have been proposed which are useable in a horizontal position or in a seat position. One of the more common types of convertible furniture includes a fixed external frame. The fixed external frame generally includes stationary supports and a back rest frame and seat frame which pivot upon the stationary supports into either a seat position or a horizontal position.

For example, various fixed external frame convertible furniture include: U.S. Pat. No. 5,153,952 to Barton et al., entitled LATCH MECHANISM FOR A CONVERTIBLE SOFA BED; U.S. Pat. No. 5,129,114 to Withers entitled FOLDING FUTON SUPPORT; U.S. Pat. No. 5,083,333 to Newton, entitled HINGE FOR A CONVERTIBLE SOFA; U.S. Pat. No. 4,538,308 to Grigoriev entitled CONVERTIBLE FURNITURE; U.S. Pat. No. 4,829,611 to Fireman, et al., entitled SOFA BED RECLINER; U.S. Pat. No. 4,996,730 to Fireman entitled SUPPORTED SOFABED RECLINER; U.S. Pat. No. 5,249,317 to Farlow entitled INVERTED-L FOR FACILITATING FOLDING OF A CONVERTIBLE SOFABED; U.S. Pat. No. 5,303,432 to Fitz entitled CONVERTIBLE FUTON FRAME; U.S. Pat. No. 5,345,626 to Newton entitled FUTON FRAME; and U.S. Pat. No. 5,485,638 to Newton entitled SELF-LOCKING FUTON FRAME.

Other types of convertible furniture frames have been proposed which include a convertible integral frame mechanism. The convertible integral frame mechanism pivots with the back rest frame and seat frame during conversion of the article of furniture between the horizontal position and the seat position and vice versa. These patents include U.S. Pat. No. 5,327,591 to Fireman, et al (hereinafter '591) entitled THREE FRAME CONVERTIBLE FUTON SOFA BED. The '591 reference discloses a three piece sofa bed recliner which has an end frame, seat frame, and back frame. The frame ends are linked in an overlapping manner. Interengaging the seat frame with the back frame enables a simple conversion process from sofa bed to recliner. The back frame and end frames fold toward each other as the interlocked seat frame is moved backward. The end frame and back frame interlock with the end frame leg and the seat frame and back frame interlock releases during conversion.

Another internally folding frame is disclosed in U.S. Pat. No. 5,201,083 to Johnson entitled SEATING TYPE ARTICLE OF FURNITURE CONVERTIBLE INTO A BED. The device to Johnson includes a two pieced frame assembly including a seat section and a back section which are pivotally attached preferably at only two discreet points. The back section includes a plurality of pairs of legs and the seat section includes a pair of legs for supporting the bed in the horizontal position.

Another convertible frame assembly is disclosed in U.S. Pat. No. 2,200,647 to Vanderploeg. Vanderploeg discloses a linkage mechanism having hinged legs supported thereon.

The above summaries of the related references should not substitute for a thorough reading of each individual reference. Each of the related art references disclosed herein are hereby incorporated by reference.

Many difficulties have not been adequately addressed by the teachings of the above related art convertible furniture devices. For example, one difficulty is that these devices do not adequately address a stable configuration for retracting and extending a support leg when converting the furniture from the seat position to the horizontal position and vice versa.

Another difficulty is that the integral frame devices do not provide adequate structural stability for locking the back rest in place when the convertible furniture is in the seat position.

A further difficulty is that the convertible furniture devices do not disclose a detachable arm rest. When the furniture is in the horizontal position, having an integral arm rest makes it difficult for the user to access the furniture.

A further difficulty is that the foldable devices do not have a manual release mechanism for controlled opening and closing when converting the furniture from a seat position into a horizontal position or vice versa. Having a device to compensate for the weight of the furniture when opening into a horizontal position prevents "banging" of the furniture on the floor.

A further difficulty is that these devices do not provide infinite adjustability for the back rest when in the seat position. Thus, permitting the user to define the optimal position of comfort.

Another difficulty is that these devices do not have a footrest. A footrest provides added comfort when use as a recliner chair.

SUMMARY OF THE INVENTION

According to the present invention, an integral frame mechanism is provided having enhanced structural support. The structural support of the present invention is enhanced through a four-bar linkage which includes a first triangular configuration of three of the linkages when in a seat position and a second triangular configuration of three different linkages when in the horizontal position. These triangular configurations provide added stability to the foldable furniture by locking one of the support legs into place when in a horizontal position. In addition, the triangular configurations allow for locking of the frame when in the seat position.

Another advantage of the four-bar linkage of the present invention is providing a linkage mechanism for retracting and extending a support leg automatically. In this manner, the user does not need to manually fold or retract the support legs when moving from the seat position to the horizontal position or vice versa.

Another advantage of the tri-fold embodiment of the present invention is that a lounge support is provided on the end frame. When the convertible furniture is in the horizontal position, the end frame may be moved into a reclining position.

A further advantage of the present invention is a detachable arm rest. The detachable arm rest when removed while in the horizontal position allows the user ease of entry and exit from the convertible furniture. When the convertible furniture is placed in the seat position, the arm rest may be placed thereon for support of the user's arm.

Another advantage of the present invention is having a manual release mechanism for controlled opening and closing of the back rest frame and end frame when converting from a seat position into a horizontal position and vice versa. By the release mechanism automatically engaging the cross bar when unfolding into the horizontal position, the back rest frame and end frame may be evenly lowered under control by the operator using leverage on the seat frame. The release mechanism is automatically engaged when moving into the horizontal position and locks the seat frame with respect to the back rest frame. The release mechanism permits the user to manually unlatch a release bar when placing the furniture in the horizontal position. When closing the frame from the horizontal position, the seat frame acts as a lever when the release mechanism is engaged to assist in breaking the horizontal position. The wheeled leg support provides stability while the seat frame is being lowered as well as permitting rolling movement of the furniture along the ground or support surface.

Another advantage is having a seat frame that is slanted backwards for better comfort.

Another advantage of the bifold embodiment of the present invention is having a self-adjusting recliner. The self-adjusting recliner includes infinite adjustability in the back rest by movement of the users back against the back rest frame. When the four-bar linkage is in an unlocked position, a slight force against the back rest by the user's back will tilt the back rest to the desired position. The weight of the user's body on the seat frame will counterbalance the pressure against the back rest frame, thus causing the desired position to be stabilized. Further, a fixed wheel leg stems from the backrest frame to rotate the seat frame upwardly thus counterbalancing the weight of the user on the seat frame and the weight that is being depressed by the back against the back rest frame.

A further advantage of the bifold embodiment of the present invention is having convertible furniture with a footrest thereon. The footrest additionally provides stability when performing the infinite adjustability.

Another advantage is providing convertible furniture which utilizes economy of material.

Although such novel features believed to be characteristic of the invention are pointed out in the claims, the invention and manner in which it may be carried out may be further understood by reference to the description following and the accompanying drawings.

A BRIEF DESCRIPTION OF THE DRAWING

Referring now to the figures in greater detail, where like reference numbers denote like parts in the various figures.

A DETAILED DESCRIPTION OF THE PREFERRED EMBODIMENTS OF THE PRESENT INVENTION

Figure 1:
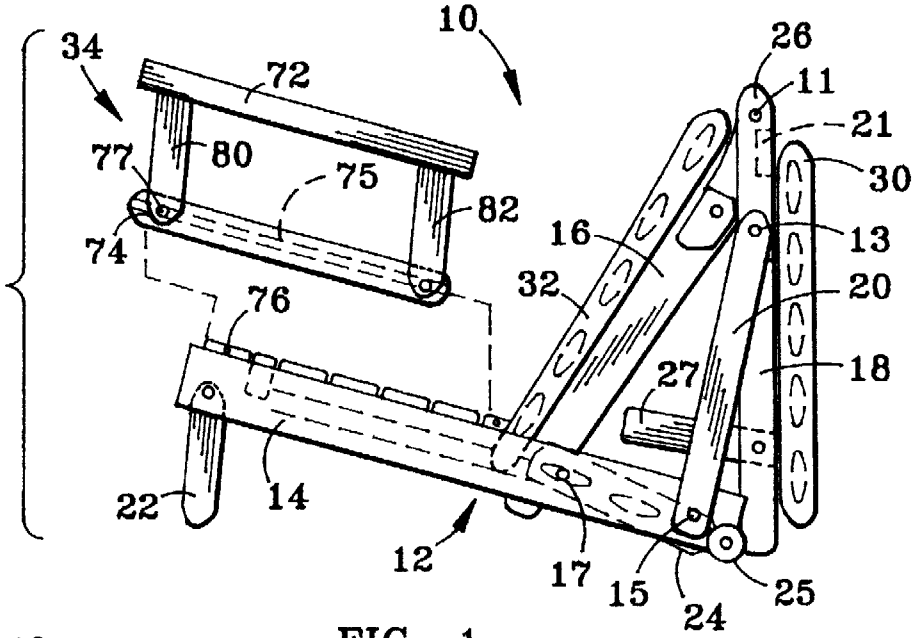
FIG. 1 is a side view of a trifold configuration of a preferred embodiment of the present invention in a seat position.

In accordance with a preferred embodiment of the present invention, FIG. 1 shows convertible furniture (e.g., trifold futon) 10. The convertible furniture 10 includes a foldable frame 12. The foldable frame 12 includes a seat frame 14, a back frame 16 and an end frame 18. Linkage 20 extends between a pivotable leg support 26 and the seat frame 14. The support leg 26 is pivotally attached to the backrest frame 16 at point 11. The support leg 26 is hingedly attached to linkage 20 at point 13. And the linkage 20 is hingedly attached to the seat rest frame at 15. Furthermore, backrest frame 16 is hingedly attached to the seat frame at 17.

The backrest frame includes an end rail 32 having slats 50 thereacross. The end frame 18 also includes an end rail 30 having slats 52 there across. Seat frame 14 does not include an end rail. However seat frame 14 includes slats 40 thereacross. The seat frame 14 does not include an end rail so that a detachable arm rest 34 may be inserted thereon. The detachable arm rest 34 includes an arm rest bar 72, support members 80 and 82 and an end rail 74 having a slot 75 therein. The slot 75 mates with the ends of the slats 40. At least two of the slats 40 include holes 76 parallel to the longitudinal axis of the slats 40 in the ends thereof for insertion of connector 77. A vertical hole (not shown) intersects the hole parallel to the longitudinal axis for inserting a connector therein. The connector may be fastened by use of an Allen wrench. Also, it is within the scope of this invention to use any other type connector for readily removing the arm rest.

On the end of the seat frame 14 is a fixed support leg 22. The back rest frame 16 includes a fixed support leg 24 having a wheel 25 thereon. The end frame 18 includes a fixed support leg 27 thereon.

The back rest frame 16 includes a stop block 19. The stop block 19 functions so that when the trifold configuration of the convertible furniture 10 is in a locked position the support leg 26 and linkage 20 are not locked in place. This creates a difficulty in the trifold embodiment because one must reach through the slats 52 to unlock the four bar linkage at cross bar 21. The convertible furniture 10 in and of itself has adequate stability. When in a seat position, the convertible furniture 10 is supported on end frame 18 and support legs 22. The wheel 25 on support leg 24 also contacts the ground. However, the weight of the user and the furniture 10 is carried on the end frames 18 and support legs 22 and not on the wheel 25.

Figure 2:
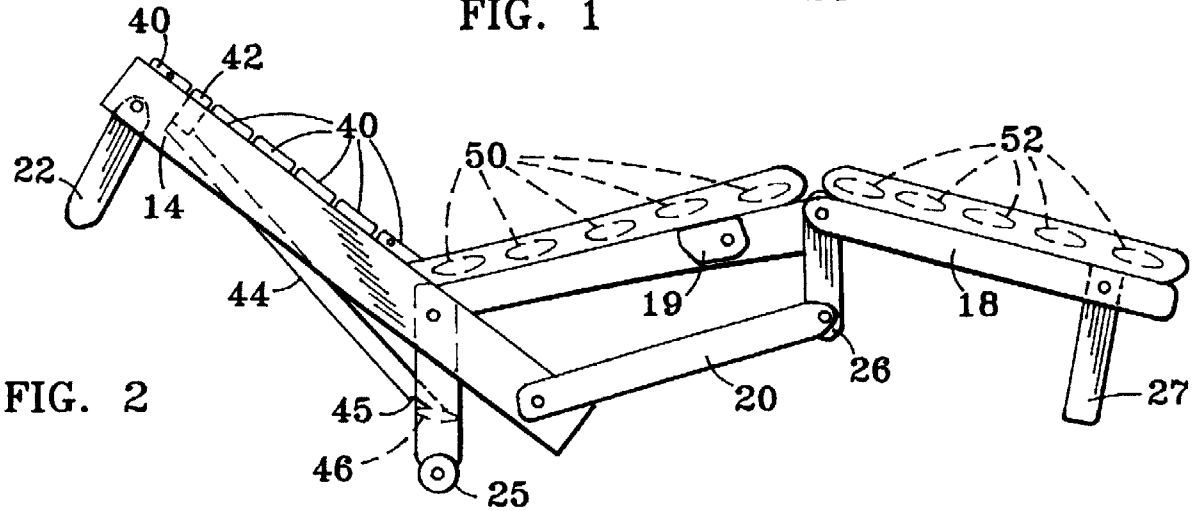
FIG. 2 is a side view of the trifold configuration of a preferred embodiment of the present invention in a first intermediate position.
Figure 3:
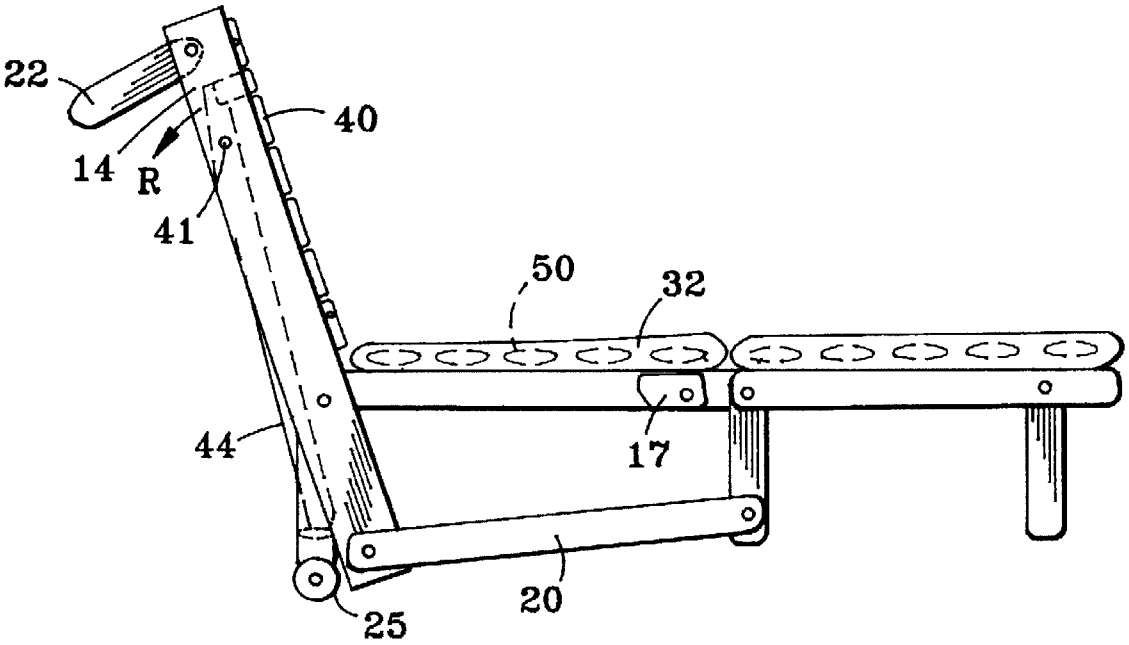
FIG. 3 is a side view of the trifold configuration of the preferred embodiment of the present invention in a second intermediate position.
Figure 4:
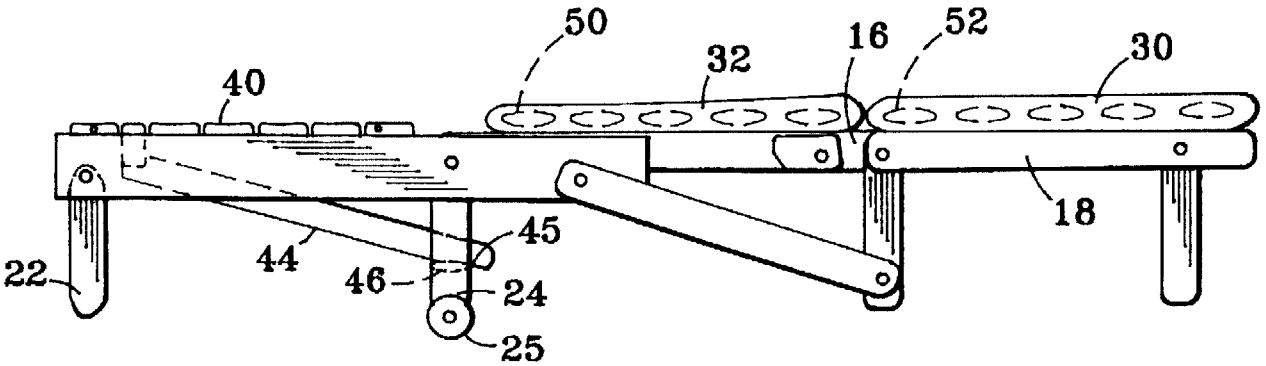
FIG. 4 is a side view of the trifold configuration of a preferred embodiment of the present invention in a horizontal position.

FIG. 2 discloses the trifold convertible furniture in an intermediate position as it is being unfolded. As it is being unfolded, the wheel 25 engages the ground and stabilizes the furniture while it is being rolled out. Further, a release mechanism 42, 44, 45, 46 including a release bar 44 and a release cross bar 42, assist in stabilizing the furniture when unfolding. Attached to leg 24 is a cross bar support 46. The cross bar support 46 is engaged by catch 45 on the release mechanism 44. The release mechanism 44 is hingedly attached to the seat frame 14 at point 41. After the frame 12 has been unfolded such that the back rest frame 16 and the end frame 18 are horizontal as shown in FIG. 3, the release bar 42 may be depressed so that it rotates along arrow R. The release bar 42 may be manually depressed by the hand of the user. After the release bar 42 is depressed, the bar 44 rotates about pivot point 41, such that the catch 45 is no longer engaged with the cross bar 46. The release bar 44 then slides over the top of the cross bar 46 such that the catch 45 is no longer engaged with the support cross bar 46. This is shown in FIG. 4.

Figure 5:
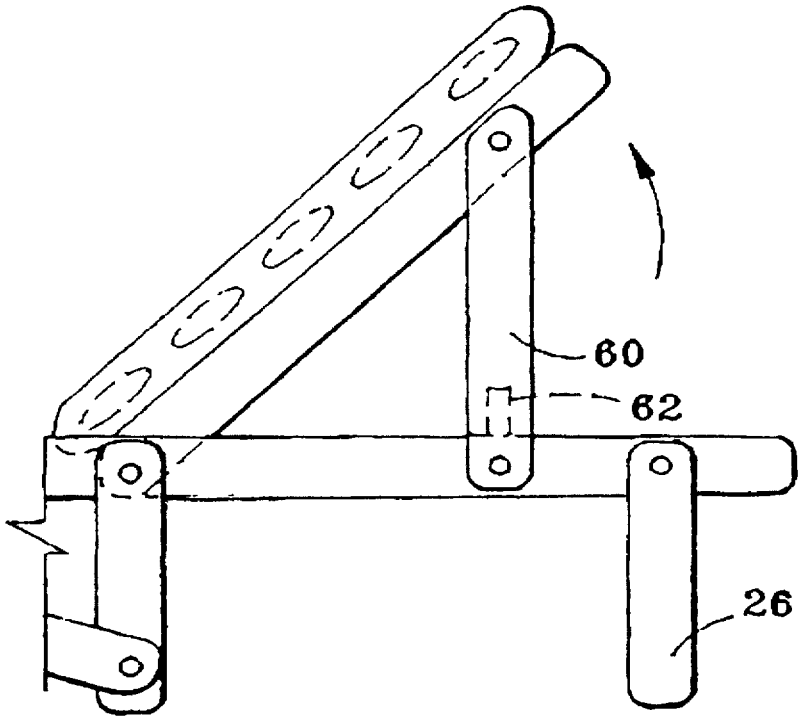
FIG. 5 is a partial side view of the trifold configuration of a preferred embodiment of the present invention depicting the lounge support opened while the present invention is in the horizontal position.
Figure 6:
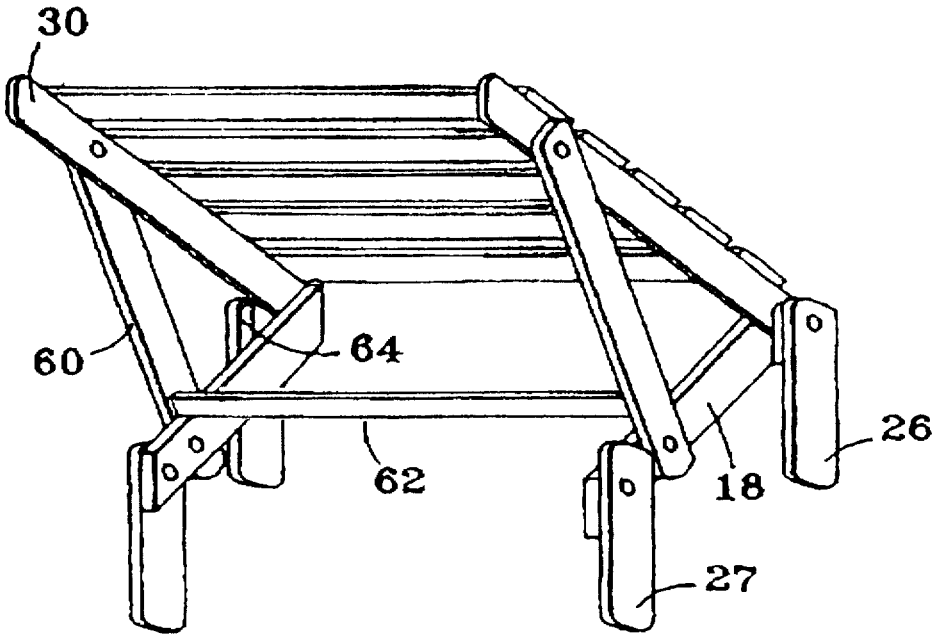
FIG. 6 is a partial perspective view of the trifold configuration of a preferred embodiment of the present invention depicting the lounge support opened while the present invention is in the horizontal position.

FIG. 5 shows a the trifold furniture configuration of a preferred embodiment of the present invention depicting the lounge support 6 opened while the preferred embodiment of the present invention is in the horizontal position. The lounge position is held in place by support 60 and cross bar 62. A spacing block 64 as shown in FIG. 6 is necessary so that the lounge supports 60 may be folded down when in the horizontal position.

Figure 8:
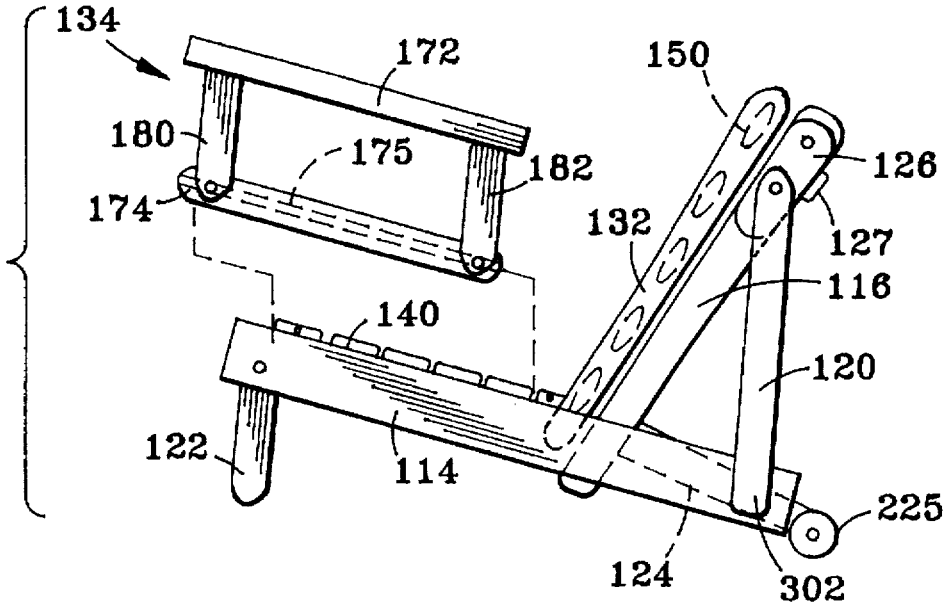
FIG. 8 is a side view of a bifold configuration of a preferred embodiment of the present invention.

FIG. 8 depicts a bifold futon embodiment of the present invention. The bifold futon embodiment does not include the stopblock 19 as used on the trifold futon embodiment. In this manner, the support leg 126 and 120 when in the seat position may lock the bifold futon embodiment in place. The support leg 126 and lounge in linkage 120 may be released through the cross bar 127. The bifold futon also includes a seat frame 114, a backrest frame 116 and end rail 132 having slats 150 thereacross. The seat frame 114 includes cross bars 140, and a fixed leg 122. The back rest frame 116 includes a fixed leg 124 having a wheel 125 thereon.

Figure 7:
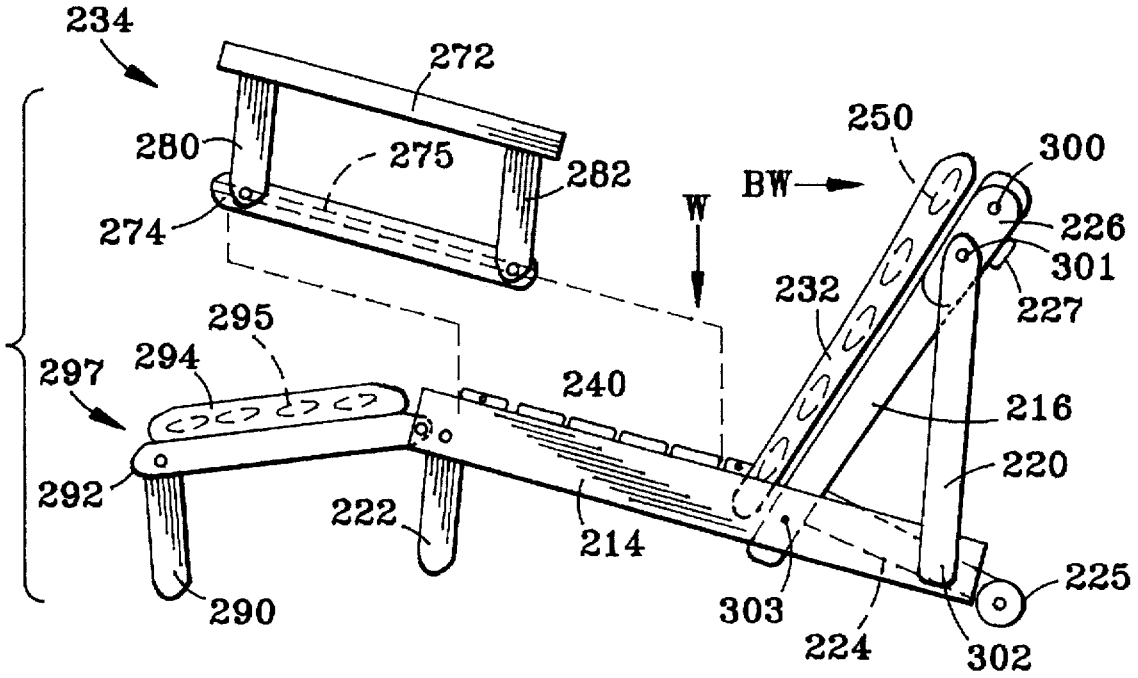
FIG. 7 is a side view of a bifold configuration of a preferred embodiment of the present invention having a footrest thereon.

FIG. 7 is similar to FIG. 8 with the exception that a footrest 297 is shown thereon. The footrest 297 includes cross slats 295 and an end rail 294. Also included is a fixed leg 290 and a footrail frame 292.

The embodiment in FIG. 7 provides for infinite adjustability of the back rest. In operation, with reference to FIG. 7, first, the user must pivot the support leg 226 and linkage 220 about pivot point 301. This is done by the cross bar 227 being pulled rearwardly along arrow Y. This disengagement will raise up the back rest frame 216 slightly and have the support leg 226 and linkage 220 in an unlocked position. The user may depress his back against the slats 250 as shown by arrow BW. As the force is applied in the direction BW, the seat frame 214 raises slightly and the support leg 224 begins to rotate toward a vertical position. The wheel 225 engages the ground and assists in the sliding motion when raising the seat frame 214. Also, weight is transferred to the wheel 225 as the frame 214 is raised. During this motion, a counterbalancing occurs between the weight applied by the back BW and the weight of the user W. The back force BW only requires a slight force because it is over a greater distance than the raising of the seat frame 214. As the seat frame 214 is raised and the backrest frame 216 becomes closer to the horizontal, the footrest frame 292 also becomes closer to the horizontal. The footrest 234 provides added stability to this motion.

It is also understood the following claims are intended to cover all of the generic specific features of the invention herein described; and all statements of the scope of the invention which as a matter of language, might fall therebetween.

What is claimed is:

1. An article of furniture comprising:

a foldable frame assembly including a seat frame and a back rest frame;

a leg having a first end and a second end, wherein said leg being hingedly attached proximate said first end to said back rest frame; and a linkage attached proximate said second end of said leg and interconnecting said leg and said seat frame such that said leg retracts proximate said back rest frame when said article of furniture is in a seat position and extends away from said back rest frame when said article of furniture is in an extended horizontal position.

2. The article of furniture of claim 1, further comprising an end frame hingedly attached to said back rest frame, said end frame including a second leg.

3. The article of furniture of claim 2, wherein said second leg is fixedly attached to said end frame.

4. The article of furniture of claim 3, wherein said back rest frame includes a stop block, whereby the leg will not extend collinear said back rest frame and interlock with said linkage when in the article of furniture is in the seat position.

5. The article of furniture of claim 2, including a lounge support including a cross bar foldable into said end frame.

6. The article of furniture of claim 1, wherein said linkage is hingedly attached to said seat frame proximate an end of said seat frame and said back rest frame is hingedly attached to said seat frame spaced from an end thereof.

7. The linkage of claim 6, wherein said back rest frame, seat rest frame and said linkage form a first triangle when in a seat position and said linkage, said leg and said back rest frame form a second triangle when in an extended horizontal position.

8. The article of furniture of claim 7, wherein said back rest frame includes a stop block, whereby the leg will not extend collinear said back rest frame and interlock with said linkage when in the article of furniture is in the seat position.

9. The article of furniture of claim 7, wherein a wheeled leg is fixedly attached to said back rest frame at an end opposite said leg.

10. The article of furniture of claim 9, wherein said wheeled leg is attached to a cross bar.

11. The article of furniture of claim 10, further comprising a release mechanism, hingedly attached to said seat frame, said release mechanism including a catch for engaging said cross bar when said article of furniture is being placed in a seat position.

12. The article of furniture of claim 1, further comprising a detachable arm rest.

13. An article of furniture comprising:

a foldable frame assembly including a seat frame and a back rest frame;

a first leg hingedly attached to said back rest frame and a second leg attached to said back rest frame in a fixed position; and a linkage interconnecting said first leg and said seat frame such that said first leg retracts proximate said back rest frame when said article is in a seat position and extends away from said back rest frame when said article of furniture is in an extended horizontal position.

* * * * *